US006481536B2

(12) United States Patent
Pfeffer

(10) Patent No.: US 6,481,536 B2
(45) Date of Patent: Nov. 19, 2002

(54) METHOD FOR ISOLATING A SINGLE CAR IN AN ELEVATOR GROUP

(75) Inventor: Claude Pfeffer, Briare (FR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/929,731

(22) Filed: Aug. 15, 2001

(65) Prior Publication Data

US 2002/0023804 A1 Feb. 28, 2002

(30) Foreign Application Priority Data

Aug. 24, 2000 (FR) ..... 00 10900

(51) Int. Cl.[7] ..... B66B 1/34
(52) U.S. Cl. ..... 187/384; 187/247
(58) Field of Search ..... 187/247, 248, 187/380, 384, 387, 388, 391, 393, 396

(56) References Cited

U.S. PATENT DOCUMENTS

| | | | | |
|---|---|---|---|---|
| 4,431,086 A | | 2/1984 | Moser et al. | |
| 4,558,298 A | * | 12/1985 | Kawai et al. | 187/380 |
| 4,691,808 A | * | 9/1987 | Nowak et al. | 187/385 |
| 4,895,223 A | * | 1/1990 | Ekholm et al. | 187/382 |
| 5,200,583 A | * | 4/1993 | Kupersmith et al. | 187/380 |
| 5,736,692 A | | 4/1998 | Lumme et al. | |
| 5,936,211 A | * | 8/1999 | Kim | 187/248 |
| 5,952,626 A | * | 9/1999 | Zaharia | 187/381 |
| 6,011,839 A | * | 1/2000 | Friedli et al. | 187/384 |
| 6,223,160 B1 | * | 4/2001 | Kostka et al. | 187/380 |
| 6,315,083 B1 | * | 11/2001 | Schuster et al. | 187/380 |

FOREIGN PATENT DOCUMENTS

| | | | |
|---|---|---|---|
| FR | 2744435 | 8/1997 | |
| JP | 1-209288 A | 2/1988 | B66B/1/14 |
| JP | 1-209288 | 2/1989 | B66B/1/14 |
| JP | 5-004779 A | 6/1991 | B66B/1/14 |
| JP | 5-051174 A | 8/1991 | B66B/1/14 |
| JP | 5-4779 | 1/1993 | B66B/1/14 |
| JP | 6-211449 A | 1/1993 | B66B/3/00 |
| JP | 5-51174 | 3/1993 | B66B/1/14 |
| JP | 6-211449 | 8/1994 | B66B/3/00 |

OTHER PUBLICATIONS

French Search Report for Ser. No. 00 10900 dated Jun. 22, 2001.

* cited by examiner

*Primary Examiner*—Jonathan Salata

(57) ABSTRACT

According to the invention, an elevator installation of the type which has a group of cars controlled by controllers (A, B, C) which communicate with each other through at least one communications loop (10, 12) and a specific protocol, includes a supervisor (14) inserted in the communications loop, and which is controlled by said protocol, and a communications system (20, 22) that allows a priority user to give commands to said supervisor, wherein a car is isolated from the set of cars, the selected car is sent to the desired level, doors closed, the user is informed that the car has arrived at the level, and the doors are opened when the user reaches the car.

7 Claims, 1 Drawing Sheet

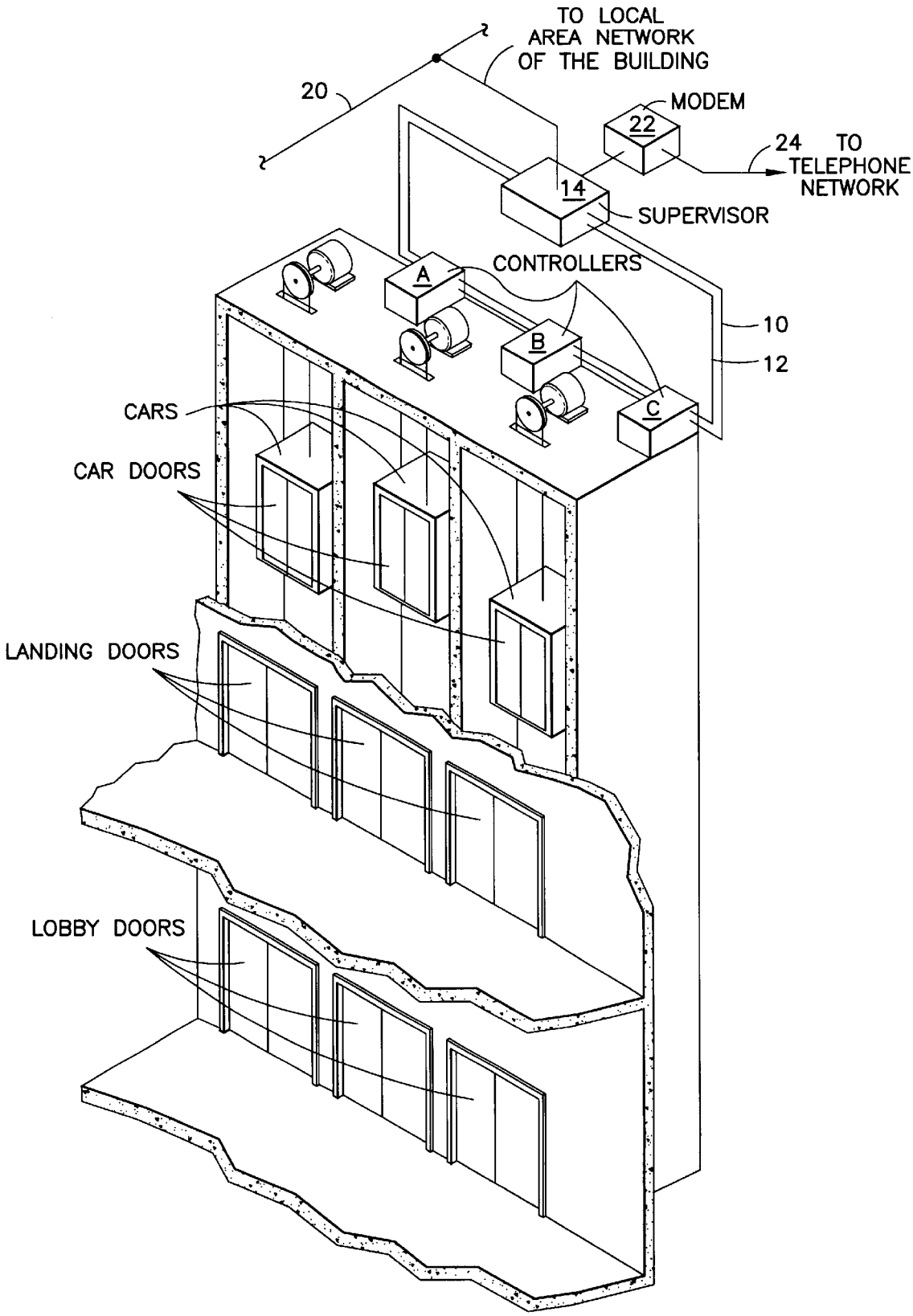
TO LOCAL
AREA NETWORK
OF THE BUILDING
20
MODEM
22
24 TO
TELEPHONE
NETWORK
14
SUPERVISOR
CONTROLLERS
A
B
C
10
12
CARS
CAR DOORS
LANDING DOORS
LOBBY DOORS

METHOD FOR ISOLATING A SINGLE CAR IN AN ELEVATOR GROUP

FIELD OF THE INVENTION

The present invention relates to an elevator installation comprising a set of cars which serve a building, where said installation is designed to allow certain users to have priority access to one of the cars. The invention also relates to a process for accessing a car in a priority manner.

BACKGROUND

Up until now, all elevator users have been treated equally, independent of their title or the emergency nature of their travel in the elevator. When a user arrives on a landing in front of the elevator of a building, he must wait for one of the cars to arrive along with all the other users already on this landing. The car will not bring him directly to his intended floor, but rather it will generally stop at intermediate floors in order to allow users to get off and/or on.

However, certain persons cannot afford time to wait for a car to become free or for it to stop during the trip. This is the case, for example, for management personnel and other distinguished persons (VIPs or Very Important Persons) who generally have their offices on the top floor of the building, and therefore in the zone which requires the longest service time. These persons are frequently in a hurry and do not like to wait. This is also the case for the transport of currency, prisoners, or persons who do not wish to be seen when they enter or leave the building.

There are known cases of certain buildings which have, in addition to an installation available to ordinary users, a private elevator installation assigned only to the VIPs. However, this solution cannot be adopted in all buildings, because it requires dedicating a relatively large area to a private installation which will be used less overall.

There is therefore a need for an elevator installation which is designed to allow a priority user to reserve one of the cars operation when he needs it.

A conventional elevator installation has a set of cars controlled by controllers which communicate with each other through at least one communications loop and a specific protocol which makes it possible to know all the landing calls and car dispatches, as well as the position of each car; to remove a given car from the set of cars, for example, in case of breakdown or maintenance of the car; and to send a car to a given level and then to open the cars doors or not upon arrival at the level. However, such an installation has the disadvantage that a user cannot intervene in the protocol in order to request that a car be assigned to him.

SUMMARY OF THE INVENTION

The objective of the present invention is to eliminate the disadvantages of known elevator installations by proposing an elevator installation that is designed to allow VIPs and similar persons to have priority access to a car without requiring the permanent assignment of a car to the priority user.

To this effect, the present invention relates to an elevator installation of the above-mentioned type, characterized by the fact that it further comprises:

a supervisor inserted in the communications loop, which is controlled by said protocol, and some means of message exchange that allows a priority user to give commands to said supervisor, wherein a car is isolated from the set of cars, the selected car is sent to the desired level, doors closed, the user is informed that the car has arrived at the level, and the doors are opened when the user reaches the car.

According to an embodiment of the invention, the supervisor consists of a personal computer or the like. In this case, the supervisor can also be connected to a computer network that exists in most modem buildings or to the Internet.

The means of message exchange can include a telephone or a microphone and a modem which are connected to the supervisor in order to receive the messages sent by the user, and a voice server which transmits the received messages from the supervisor to the user.

An advantage of the invention is that if the protocol used by the set of elevators is sufficiently advanced, the setup of the invention will require no adaptation or modification of the controllers of the elevators, and consequently, the cost of modernization for an existing installation will be similar to that of the setup of the invention in a new installation.

The elevator installation according to the invention makes it possible by means of a computer program to do one or more of the following tasks:

to receive a telephone call sent by the priority user;
to identify a key pressed on the calling telephone;
to compose a telephone number;
to recover a voice message from the modem;
to transmit a voice message to the modem; and
to interrupt the transmission of a voice message.

BRIEF DESCRIPTION OF THE FIGURE

The FIGURE shows a block diagram of an elevator installation equipped with a system allowing priority access to a car.

DETAILED DESCRIPTION OF A PREFERRED EMBODIMENT

In this FIGURE, it has been assumed that the elevator installation has three cars, but it goes without saying that the number of cars can be something other than three. Only controllers A, B and C which control the cars have been represented in the FIGURE. The controllers communicate with each other through two communications loops 10, 12.

According to the invention, supervisor 14, such as a personal computer, is inserted in the communications loops. This computer has a voice modem (connected to the computer bus) or external modem 22 (connected via an RS 232 serial port, for example). Voice modem 22 is connected to telephone network 24. The supervisor can also be connected to the local area network 20 of the building.

1. Operation of the Elevator Installation

Parameterization of the voice messages on site

Voice messages transmitted by a priority user through a microphone or a telephone can be stored locally. This allows one to personalize the voice messages locally in order to avoid language problems and to personalize the messages even more (messages recorded in a branch or on site).

In order to parameterize a message locally, it is possible to provide two special secret parameterizing codes, one for a voice signal coming from a microphone directly connected to the modem, the other for a voice signal coming from a telephone.

A voice program guides the user, asking him to enter numerical values on the keyboard and to enter messages with the microphone. It is then possible to listen to the messages again, to re-record them, and to reduce them at the beginning and the end (elimination of the "blanks").

The mode of use of the priority access system will now be described.

2. Arrival of the Priority User Near the Building

When the priority user arrives in the vicinity of the building, the following operations are done:

the user calls the number of the modem (reception of call), the modem asks the user to enter his secret numerical code (transmission of a first voice message), the modem provides supervisor 14 with the entered number (interruption of the transmission of the message as soon as a number is entered in order to optimize the cycle time, identification of the pressed keys, error message display if the code is wrong, then repetition of the process if necessary), the modem then asks the user to enter the level where he intends to board (transmission of a second voice message), the modem provides the supervisor with the entered number (the * key can be used as a "–" (minus sign) for buildings with underground levels), the modem confirms the request with a voice message, for example, by transmitting a message such as "Thank you Mr. X, a car will be waiting for you at level 0."

The supervisor then waits for a car to be empty, isolates it from the set of elevators so that it will no longer respond to landing calls, and then waits for no more orders to be transmitted from inside the car. The supervisor then sends the car to the desired level giving it the order not to open its doors when it arrives at this level.

Once the car is waiting, it is possible to program a call-back of the user with transmission of a voice message in order to indicate to the user that the car is waiting and optionally the number or the name of the car. The number at which the user is called back is a function of the entered secret code. The option of the number or name of the car can be triggered or not as a function of the level where the car is waiting. In effect, this option is of interest when the priority user wishes to leave the building since his office is two steps from the elevators, but it is of no interest if he arrives by automobile.

3. Arrival of the Priority User in Front of the Elevators

When he arrives in front of the elevators, the priority user calls back the modem. The modem asks him again for his secret numerical code. Once the code is entered, if the car has already arrived, the supervisor gives it the order to open its doors, if the car has not yet arrived, the supervisor sends a wait message to the user through the modem, and asks the car to open its doors as soon as it arrives.

A variant for opening the doors of the car without using the telephone consists of using a badge or the like, especially if such a system is already connected to the elevator for another use.

4. Boarding the Car

The priority user boards the car and selects his destination in the traditional manner. Given that the car is in independent mode, it will not respond to active landing calls. Consequently, the car will make the trip without intermediate stops. After the car has arrived at the destination, the supervisor returns the car to group service.

5. Case in Which the Car Arrives at the Level Before the Priority User

In this case, it is possible to provide a telephone key allowing the user to indicate that he is in front of the elevators, which will automatically trigger the opening of the doors of the car.

In order not to immobilize the operation of the set of elevators for too long, the supervisor can return the reserved car back into the group if the person has not claimed this car after a certain amount of time after its arrival. This situation can occur if the priority user changes his mind or if he takes another car which happened to arrive at an opportune moment. This time limit can vary according to whether the car is at a ground level (longer for the ground floor or underground levels) or at an upper level.

6. Leaving From the Office

When the priority user wishes to leave his office, he can use a procedure similar to that described above. With the same secret code mentioned above, it is possible to enter a number that is a function of the level where the user calls the elevator, and that is, for example, the telephone number of his automobile in the case in which he is calling from the ground floor or underground levels, the telephone number of his office if he is calling from the level where his office is located, or the number of his cellular telephone for the other levels.

7. Other Communications Possibilities

Since the supervisor is a personal computer, it can also be connected to the computer network of the building or to the Internet. It is then possible to use the message service either to reserve the car or to indicate his arrival.

As indicated above, the principle of reserving a car can prove to be of interest, for example, for the transport of currency, prisoners, or persons who do not wish to be seen. In this case, it is possible to improve the functionality of the system in order to limit the risk of undesirable encounters as much as possible, but it should be understood that this is done to the detriment of the performance of the set of elevators.

Thus, it is possible to indicate that the car has arrived and is waiting only if there is no landing call at this level and there is no car dispatch with the destination of this level, with a safety time limit after the last car arrival at said level in order to allow people time to exit.

Likewise, it is possible to open the doors after arrival of the car at the destination only when there is no car dispatch with destination of this level, with a safety time limit after the last car arrival at this level.

It is also possible to always reserve the same car, for example, a car arranged for a greatly handicapped person, an armored car, or a car that is the only one that can access a given level.

What is claimed is:

1. A method for isolating a single car from a group of elevator cars normally controlled collectively for the benefit of a priority user, characterized in that the method includes the following steps:

a) the user telephoning a supervisory computer connected to a control system of the elevator group;

b) the supervisory computer identifying the user by an identification code;

c) the user transmitting boarding information to the supervisory computer;

d) the supervisory computer confirming the user's request by a voice message and commanding the control system to isolate a single car and dispatch the isolated car to a requested boarding level;

e) identifying the car to be isolated, f) causing the isolated car to not respond to landing calls, g) recognizing the absence of any car calls entered from within the isolated car, h) dispatching, responsive to the absence of any car calls, the isolated car to the requested boarding level, and i) maintaining the landing doors of the isolated car in a closed position until after the user has arrived.

2. The method as recited in claim 1, further including the step of transmitting a voice message to the user after the car has arrived at the selected landing.

3. The method as recited in claim 2, further including the steps of receiving an arrival message from the user indicating that the user is in front of the landing doors of the isolated car, and responsive to the arrival message, opening the landing doors immediately upon the concurrent arrival of both the user and the isolated car at the selected landing.

4. The method as recited in claim 1, further including the step of returning the isolated car to the collective group control upon delivery of the priority user to final destination.

5. The method as recited in claim 1, further comprising the step of returning the isolated car to the collective group control in the event the user has not arrived at the selected landing within a predetermined time.

6. The method as recited in claim 2, further comprising the step of delaying the step of transmitting a voice message to the user announcing the arrival of the isolated car until such time as there are no other landing calls or destination calls for other cars at the selected level.

7. The method as recited in claim 6, wherein the delaying step includes the step of additionally delaying transmitting a voice message to the user for a safety time period after the most recent arrival of another car at the selected level, whereby other users are permitted time to exit the selected landing.

* * * * *